US007988159B2

(12) United States Patent
Chen

(10) Patent No.: US 7,988,159 B2
(45) Date of Patent: Aug. 2, 2011

(54) LEAN-TO-TURN WHEELED DEVICE

(76) Inventor: Shane Chen, Camas, WA (US)

( * ) Notice: Subject to any disclaimer, the term of this patent is extended or adjusted under 35 U.S.C. 154(b) by 110 days.

(21) Appl. No.: 12/195,183

(22) Filed: Aug. 20, 2008

(65) Prior Publication Data

US 2010/0044981 A1 Feb. 25, 2010

(51) Int. Cl.
*A63C 17/02* (2006.01)

(52) U.S. Cl. ..... 280/11.27; 280/11.19

(58) Field of Classification Search .... 280/11.19–11.28, 280/87.01–87.043, 47.131–47.331
See application file for complete search history.

(56) References Cited

U.S. PATENT DOCUMENTS

| | | | | | |
|---|---|---|---|---|---|
| 280,236 | A * | 6/1883 | Phillips | 280/11.19 |
| 2,430,037 | A * | 11/1947 | Vincent | 280/11.209 |
| 4,087,104 | A * | 5/1978 | Winchell et al. | 280/210 |
| 4,185,847 | A * | 1/1980 | Johnson | 280/87.042 |
| 5,551,717 | A * | 9/1996 | De Courcey Milne | 280/87.042 |
| 6,158,752 | A * | 12/2000 | Kay | 280/87.042 |
| 6,173,975 | B1 * | 1/2001 | Brandner | 280/11.223 |
| 6,341,790 | B1 * | 1/2002 | Chen | 280/87.041 |
| 2007/0262546 | A1 * | 11/2007 | Bertiller | 280/87.042 |

* cited by examiner

*Primary Examiner* — J. Allen Shriver, II
*Assistant Examiner* — Erez Gurari

(57) ABSTRACT

A wheeled device having pairs of wheels positioned on opposite sides (e.g. skateboard or "quad" skate) that includes a base and at least one turnable wheel assembly. A turnable wheel assembly includes two wheels having negative camber angle, and is configured such that the axles of the wheels can pivot about an axis disposed substantially perpendicular to the direction of travel. This configuration is conducive to the use of large wheels.

9 Claims, 7 Drawing Sheets

100

LEAN-TO-TURN WHEELED DEVICE

FIELD OF THE INVENTION

The present invention relates to wheeled devices having pairs of wheels positioned on opposite sides, such as "quad" roller skates, skateboards, and other similar devices. More specifically, the present invention relates to enhancing the turnability of such wheeled devices.

BACKGROUND OF THE INVENTION

The prior art is replete with "lean-to-turn" mechanisms that enhance the turnability of wheeled devices having parallel pairs of wheels. Such mechanisms are usually in the form of trucks and axles designed to cause two parallel wheels to turn in unison when the wheeled device is tilted to one side or the other. One of the most common and well-known instances of this is in skateboards and "quad" skates such as the wheeled skate disclosed in U.S. Pat. No. 3,442,523. The '523 patent discloses a conventional roller skate having two pairs of wheels. Each pair of wheels has a wheel mount assembly including an angled shaft and an axle that is common to the paired wheels. Leaning the skate to one side causes the skate "shoe" portion to rotate about the wheel assembly shafts which in turn causes each common axle and the paired wheels attached thereto to rotate substantially in the horizontal plane, thereby causing the skate to experience enhanced turning. Conventional skateboards have turning mechanisms that operate in generally the same way.

Among other disadvantages of this arrangement, it is often not conducive to the use of wheels significantly larger than those normally used in the art. Larger wheels may be desirable because they travel more smoothly over bumpy, uneven, or textured surfaces such as dirt, cobblestones, and cracks and grooves in cement. Usually, wheels of any size are mounted on the underside of a platform such that the wheels are entirely below the level of the platform. Large wheels therefore require a higher platform, which may cause instability due to a high center of gravity. One way to avoid this problem is to configure the trucks such that the wheels are outside the perimeter of the platform, thus allowing for a lower platform than would be possible if the wheels were directly beneath the platform. However, this may cause the platform to interfere with the movement of the trucks and wheels. For example, since the wheels are mounted on the ends of the pivoting trucks, they have a wide range of movement and may come into contact with the platform while turning. This is especially likely when the wheels are large. Various modifications to the wheels, trucks, and/or platform can be devised to avoid this, but these tend to require sacrifices of simplicity and convenience. For example, mounting the wheels farther away from the platform reduces the chance of their hitting the platform, but also increases the size of the wheeled device, thus making it less portable.

The turnable wheel assembly disclosed in U.S. Pat. No. 7,306,240, by the same inventor, although designed with the preferred embodiment being an inline skate, may also be applied to a "quad" wheel arrangement. The distinguishing feature of the turnable wheel assembly in the '240 patent is that the orthogonal distance between the two parallel wheels, as well as the orthogonal distance between either of the wheels and the centerline of the skate, remains substantially the same during a turn. This enables the two wheels to be placed very close together without the risk of the wheels coming into physical contact while turning. This can be configured for the purposes of the present invention by spacing the wheels farther apart so that they are outside of the perimeter of the platform or base, thus achieving a similar result. However, the present invention is better suited to the purpose of the "quad" wheel arrangement because it is mechanically simpler.

A need thus exists for a wheeled device, having paired wheels larger than those normally used in the art, that provides enhanced turnability. Needs also exist for such a wheeled device that is relatively compact, lightweight, and mechanically simple.

SUMMARY OF THE INVENTION

The present invention is intended to overcome shortcomings of the prior art and positively contribute to the wheeled skate and skateboard arts. Among other aspects, the present invention provides a turnable wheeled device with enhanced turning capabilities and the potential for wheels significantly larger than those normally used in the art.

In one aspect, the present invention includes a turnable wheeled device (such as a skate or skateboard) having at least one turnable wheel assembly, and the turnable wheel assembly may include two wheels supported by axles and having negative camber angle. During a turn, the axles of the two wheels pivot about an axis substantially perpendicular to the direction of travel.

In another aspect, the present invention includes a turnable wheeled device (such as a skate or skateboard) having at least one turnable wheel assembly, and the turnable wheel assembly may include two wheels supported by wheel axles and having negative camber angle, each wheel axle being part of a shaft member rotatable by means of a base axle. In addition to being angled to produce negative camber, the wheel axles are horizontally offset from the base axles. This configuration inherently produces turning when the wheeled device is leaned or tilted to one side or the other.

The attainment of the foregoing and related advantages and features of the invention should be more readily apparent to those skilled in the art, after review of the following more detailed description of the invention taken together with the drawings.

DETAILED DESCRIPTION

Figure 1:
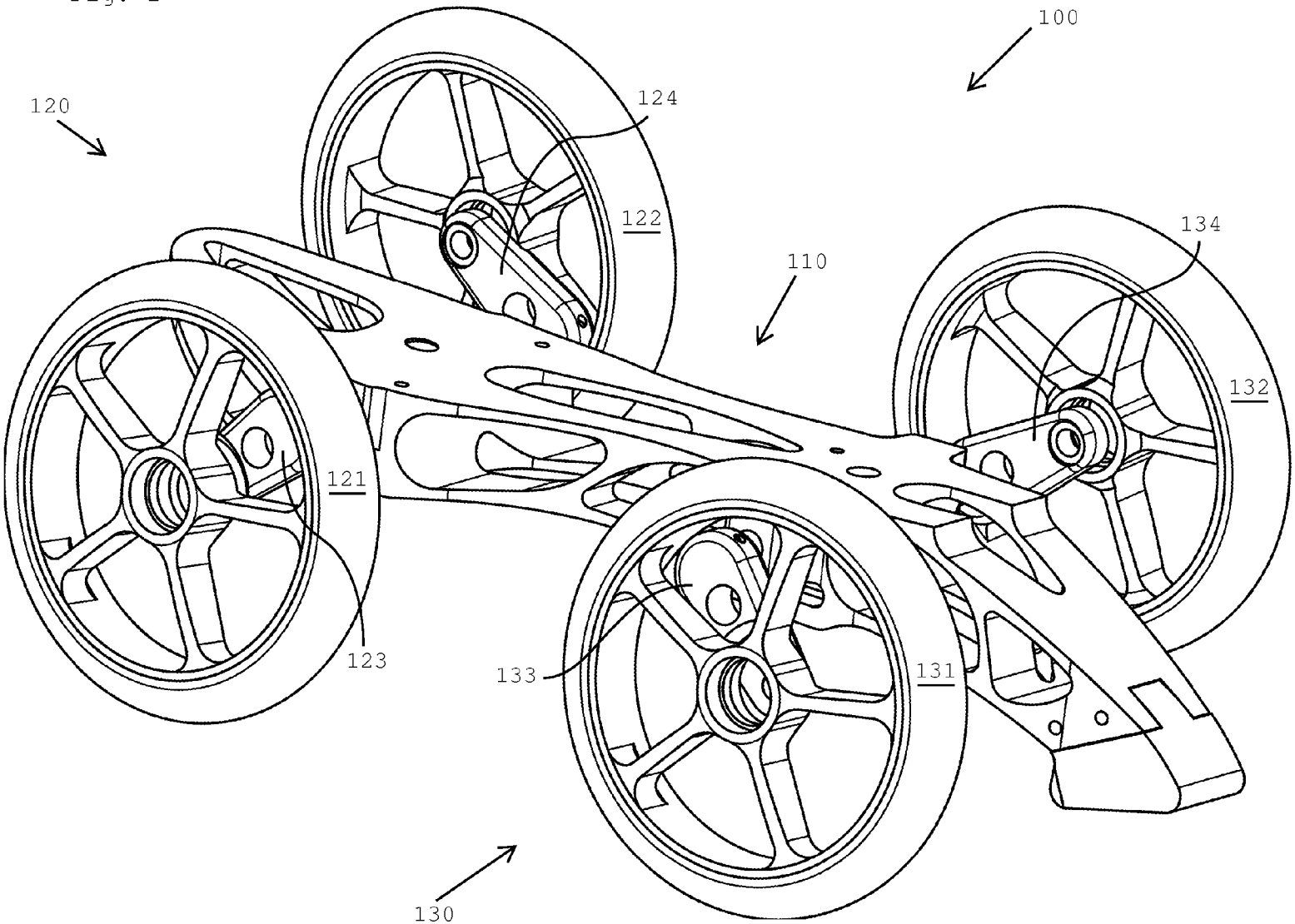
FIG. 1 is a perspective view of an embodiment of a wheeled device in accordance with the present invention.

Referring to FIG. 1, a perspective view of one embodiment of a wheeled device 100 in accordance with the present invention is shown. In the embodiment of FIG. 1, there may be a front turnable wheel assembly 120 and a rear turnable wheel assembly 130. These assemblies provide tilt- or lean-based turning. The front turnable wheel assembly 120 may include a first wheel 121 and a second wheel 122, respectively coupled to shaft members 123, 124; and the rear turnable wheel assembly 130 may include a first wheel 131 and a second wheel 132, respectively coupled to shaft members 133, 134. Shaft members 123, 124, 133, 134 may be rotatably coupled to base 110. Base 110 is laterally tiltable. It should be recognized that base 110 may be formed of various materials (plastic, metal, etc.) and in a wide range of configurations.

Figure 2:
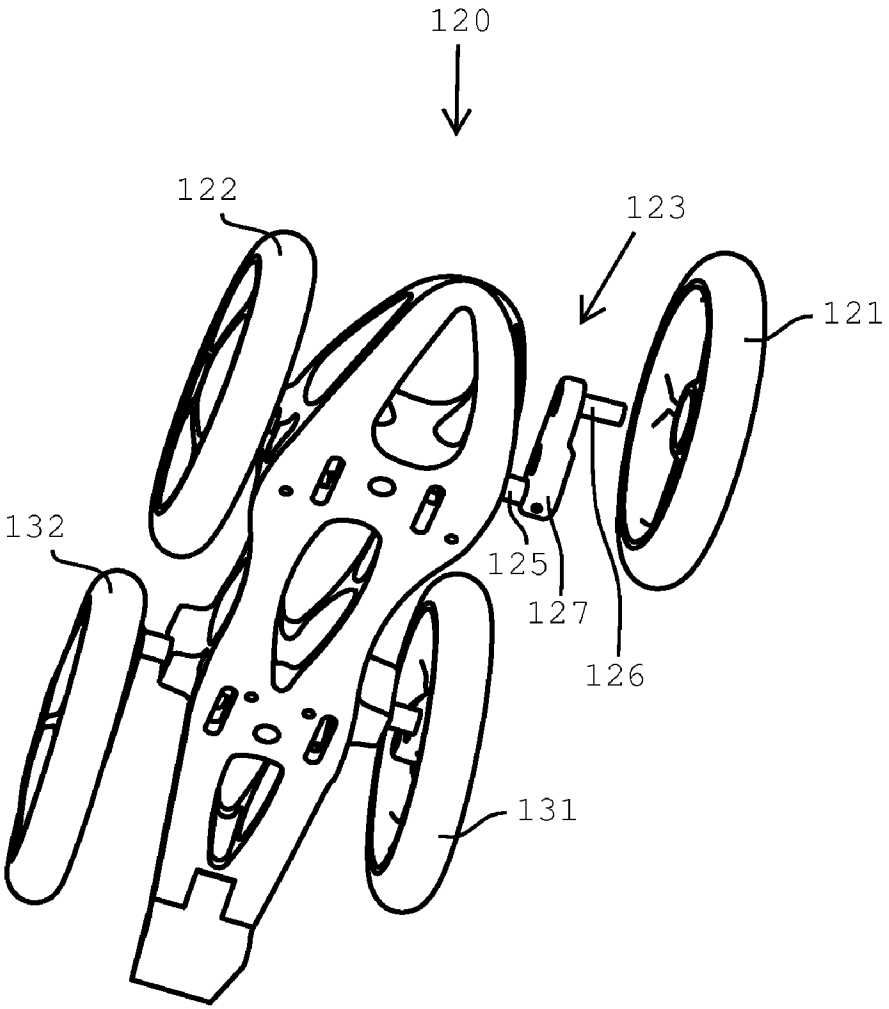
FIG. 2 is a perspective view of the wheeled device of FIG. 1 with one wheel detached from its axle, in accordance with the present invention.

Referring to FIG. 2, a perspective view of wheeled device 100 in accordance with the present invention, with wheel 121 detached, is shown. Wheeled device 100 may include a front turnable wheel assembly 120, which may include wheel 121 and shaft member 123. Shaft member 123 may include base axle 125, which is rotatably coupled to base 110, and wheel axle 126, which is coupled to wheel 121. In the non-turning position, wheel axle 126 is angled upward so that wheel 121 has a negative camber angle (i.e. wheel 121 slants inward toward the top). Wheel axle 126 is offset from base axle 125. The wheel axles in front turnable wheel assembly 120 are offset forward, and the wheel axles in rear turnable wheel assembly 130 are offset backward. The differences in orientation between base axle 125 and wheel axle 126, caused by the camber angle and by the offset, result in the axis of wheel axle 126 and the axis of base axle 125 being not coplanar. Shaft member 123 may also include a connecting means to bridge the offset between base axle 125 and wheel axle 126, such as middle section 127.

A cavity may be provided on the proximal side of each of wheels 121, 122, 131, 132, whereby middle sections 127 of shaft members 123, 124, 133, 134 can be at least partially contained inside their respective wheels, thus reducing the overall width of wheeled device 100. In the embodiment of FIG. 2 such cavities are created by the absence of spokes on the proximal sides of wheels 121, 122, 131, 132, but the cavities can take a variety of different forms in other embodiments.

Figures 3, 4, 5:
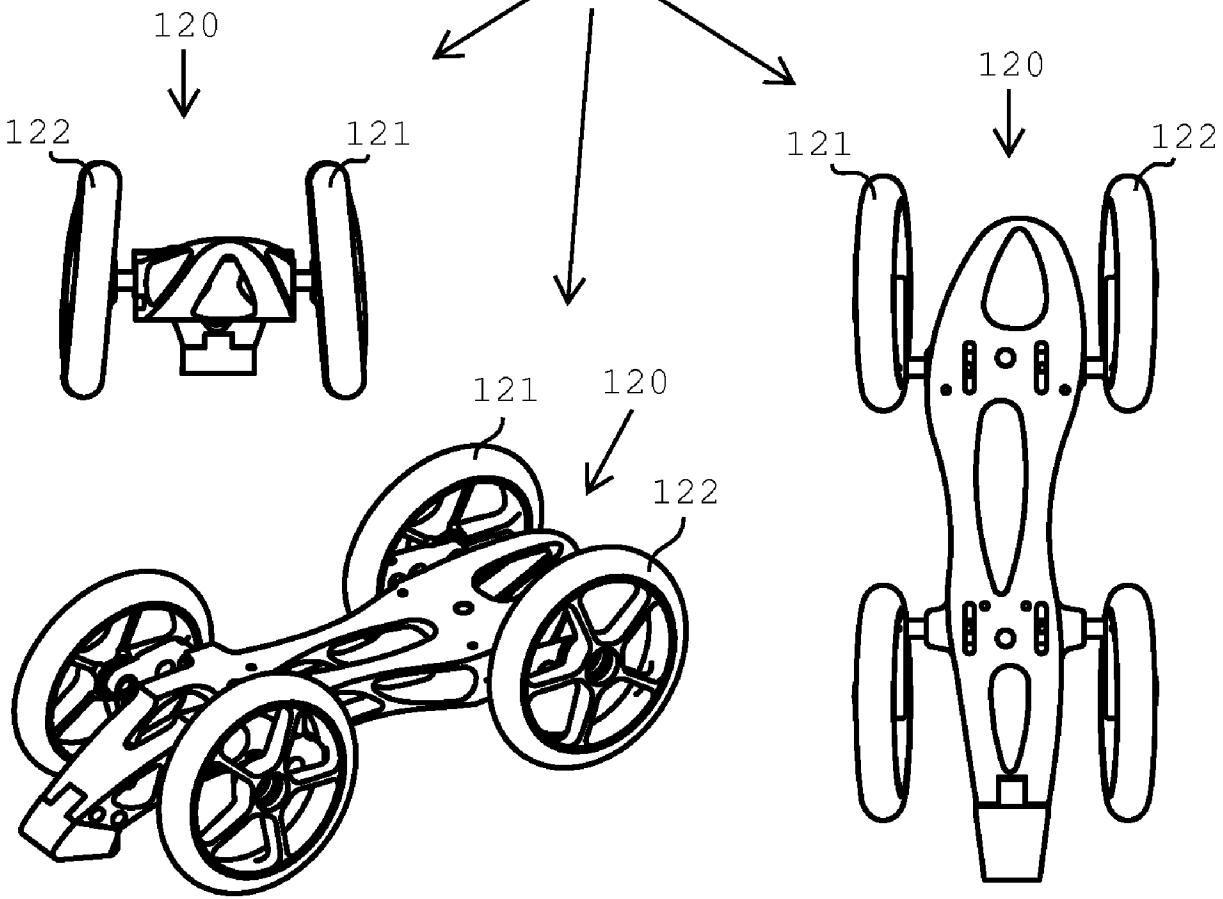
FIGS. 3-5 are front, perspective, and bottom views of the wheeled device of FIG. 1 in non-turning position in accordance with the present invention.

Referring to FIGS. 3-5, front, perspective, and bottom views of wheeled device 100 in non-turning position in accordance with the present invention are respectively shown. In the non-turning position, force is apportioned an approximately equal amount over both wheels 121, 122 of turnable wheel assembly 120. Wheels 121 and 122 are not angle toward the left or right, so wheeled device 100 continues to travel forward without turning.

Figure 8:
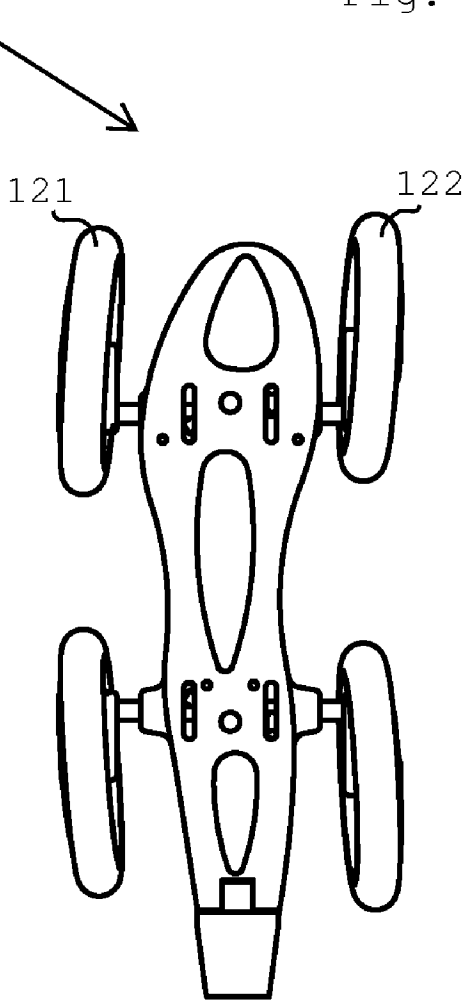
FIGS. 6-8 are front, perspective, and bottom views of the wheeled device of FIG. 1 making a left turn in accordance with the present invention.
Figure 6:
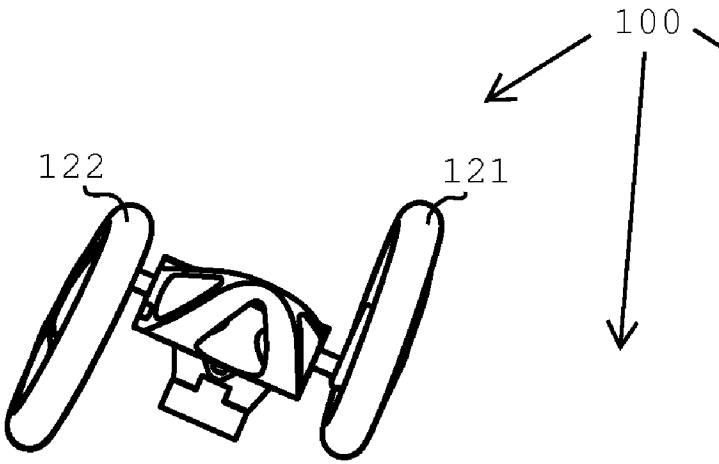
Figure 7:
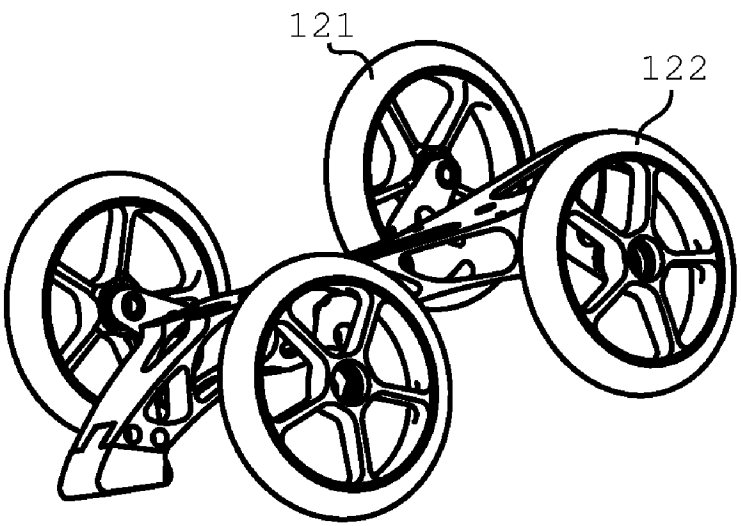

Referring to FIGS. 6-8, front, perspective, and bottom views of wheeled device 100 making a left turn in accordance with the present invention are respectively shown. Turning is initiated by tilting base 110 to one side or the other. Since each wheel is coupled to its respective shaft member 123 or 124 which rotates by means of its respective base axle 125 (see FIG. 2), shaft members 123, 124 pivot as base 110 is tilted so as to maintain contact of all wheels to the ground. When base 110 is tilted to the left, the rotation of shaft member 123 causes wheel axle 126, and therefore wheel 121, to be deflected upward and toward the rear. The change in position causes a corresponding change in the orientation of wheel axle 126; whereas in the non-turning position shown in FIGS. 3-5 wheel axle 126 is angled upward and in no other direction, in the left-turning position the angular displacement of shaft member 123 has caused wheel axle 126 to rotate so that, while its upward incline has decreased, its angle has taken on a rearward component. Since wheel 121 is perpendicular to wheel axle 126, wheel 121 is now angled to the left.

Analogous processes occur on the other side of turnable wheel assembly 120 to achieve angling of wheel 122. Since rotation of shaft member 123 in one direction coincides with rotation of shaft member 124 in the opposite direction due to the unequal distribution of force during tilting, and since in the non-turning position wheel 121 and wheel 122 are inclined in opposite directions (to produce the negative camber angle), tilting of base 110 causes both wheels to be angled in the same direction, whereby wheeled device 100 turns toward the direction of tilting.

Tilting base 110 to the right achieves a similar effect, albeit with the wheels 121, 122 receiving forces generally opposite of those described above, and hence changing angle to turn wheeled device 100 in the opposite direction.

In this embodiment rear turnable wheel assembly 130 is provided. Rear turnable wheel assembly 130 is substantially similar to front turnable wheel assembly 120, but is positioned in the converse direction, i.e., wheel axles 126 offset backward instead of forward. This causes wheels 132 and 133 to become angled during a turn in the direction opposite to the direction of tilting of base 110. The opposite turning directions of front turnable wheel assembly 120 and rear turnable wheel assembly 130 enhance the overall turning ability of wheeled device 100 by enabling turns of smaller radius.

Figure 9:
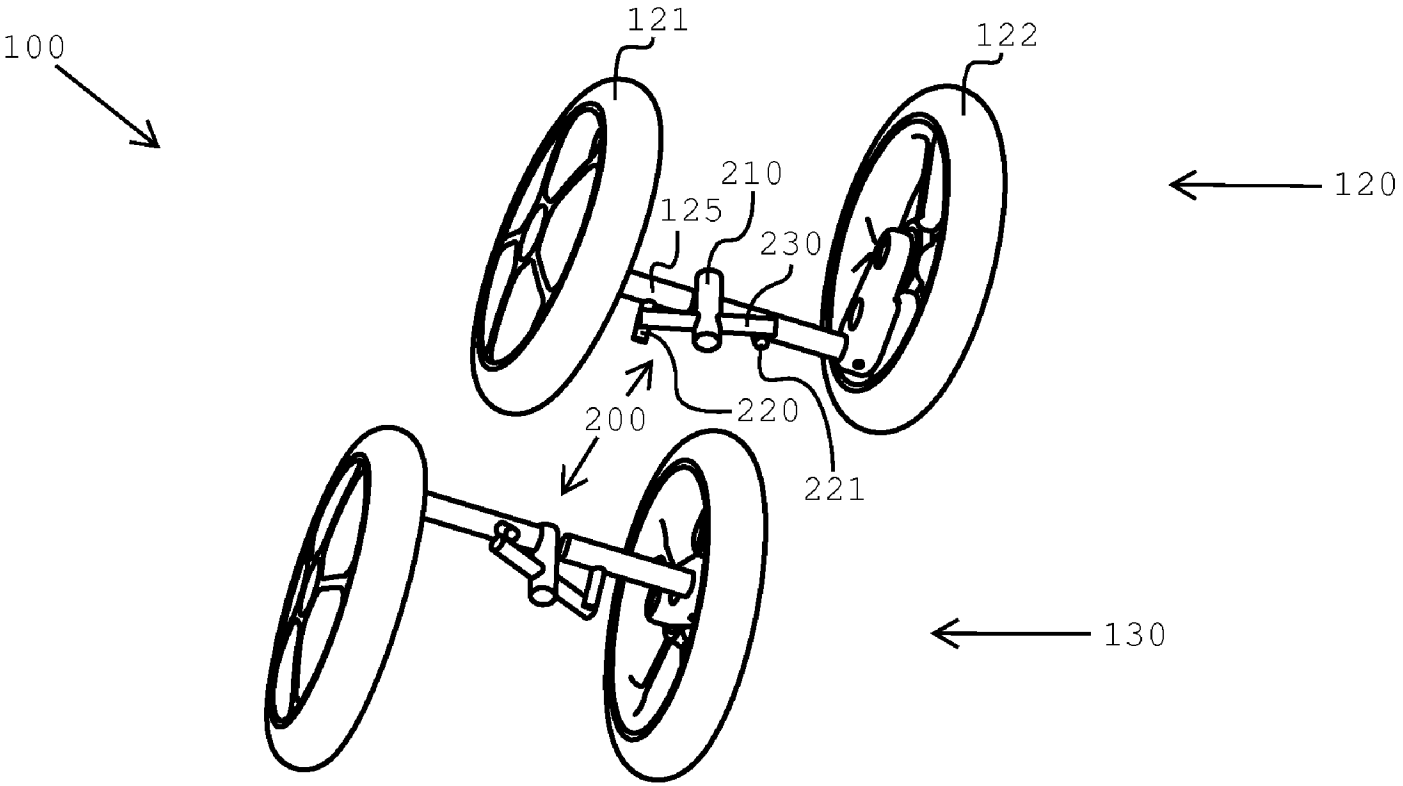
FIG. 9 is a perspective view of two turnable wheel assemblies in turning position in accordance with the present invention, with the base not shown.

Referring to FIG. 9, a perspective view of two turnable wheel assemblies in turning position in accordance with the present invention are shown, with base 110 excluded for clarity. Each turnable wheel assembly 120, 130 preferably includes a linking mechanism 200, which ensures that both wheels associated with the same turnable wheel assembly undergo substantially equal changes in angle when turning. In the embodiment shown, linking mechanism 200 may include shaft 210 protruding from base 110, positioning protrusions 220, 221 coupled to base axles 125, and linking bar 230, which may be coupled to linking shaft 200 at a substantially perpendicular angle. Positioning protrusions 220, 221 are adjacent to linking bar 230.

When turning, the rotation of base axles 125 causes the first positioning protrusion 220 to press against the corresponding end (the first end) of linking bar 230 with increased force. Linking bar 230 pivots about linking shaft 210, and the second end of linking bar 230 forces the second positioning protrusion 221 to pivot through a distance substantially equal to that of positioning protrusion 220, albeit in the opposite direction. Thus shaft members 123, 124 likewise rotate to substantially equal degrees in opposite directions, and wheels 121, 122 are angled to point in substantially the same direction.

Figure 10:
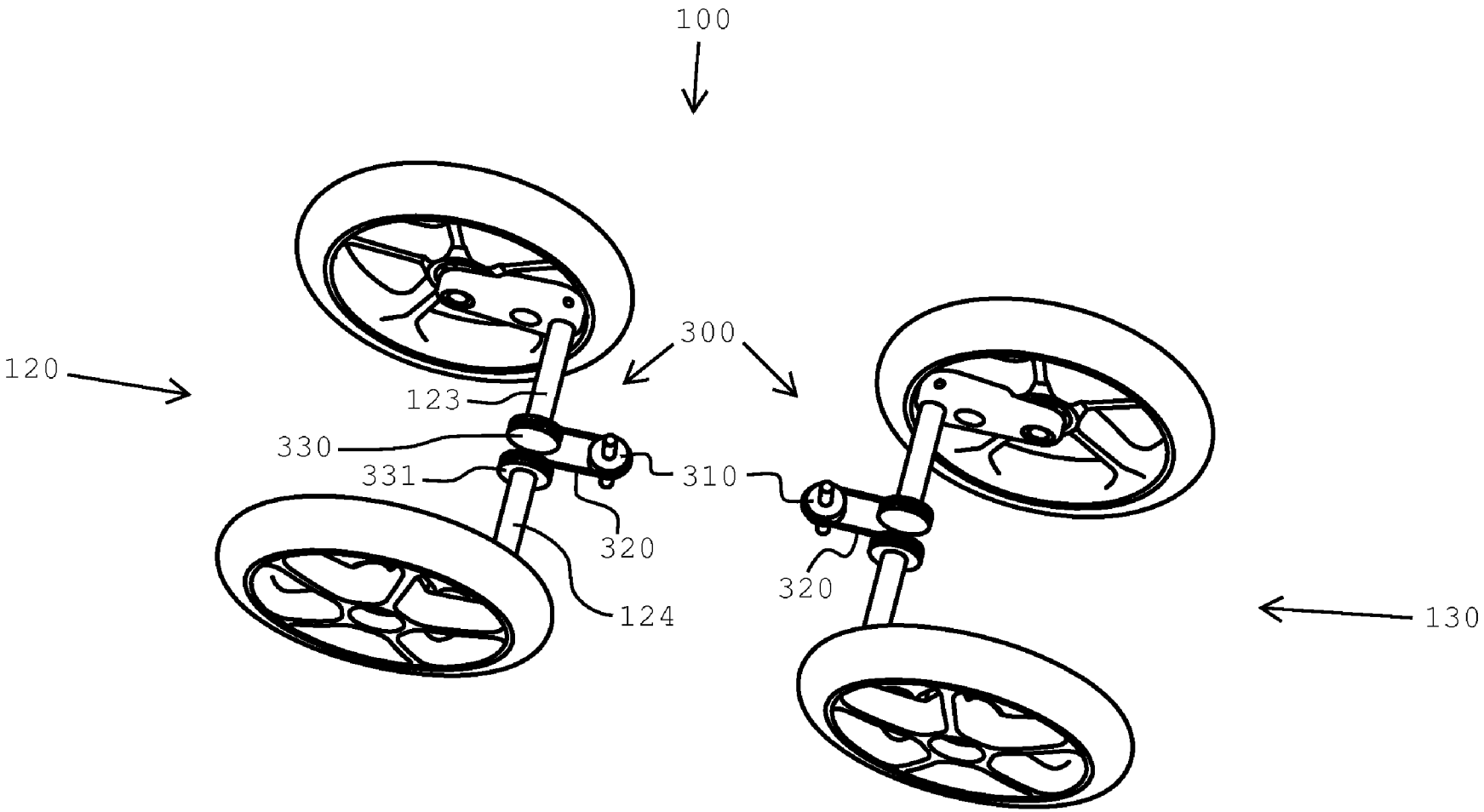

Referring to FIG. 10, a perspective view of two turnable wheel assemblies in turning position in accordance with the present invention are shown, with base 110 excluded for clarity. Each turnable wheel assembly 120, 130 may include a linking mechanism 300, which ensures that both wheels associated with the same turnable wheel assembly undergo substantially equal changes in angle. In the embodiment shown, linking mechanism 300 may include pulley 310, and linkage cable 320 communicating with pulley 310. Shaft members 123, 124 may be respectively coupled to spools 330, 311. Linkage cable 320 may be wound around spool 330 on one end and 331 on the other end. Pivoting of one shaft member in one direction further winds linkage cable 320 around the corresponding spool, causing linkage cable 320 to unwind from the other spool by means of pulley 310, thereby causing the other shaft member to pivot in the opposite direction.

Figure 11:
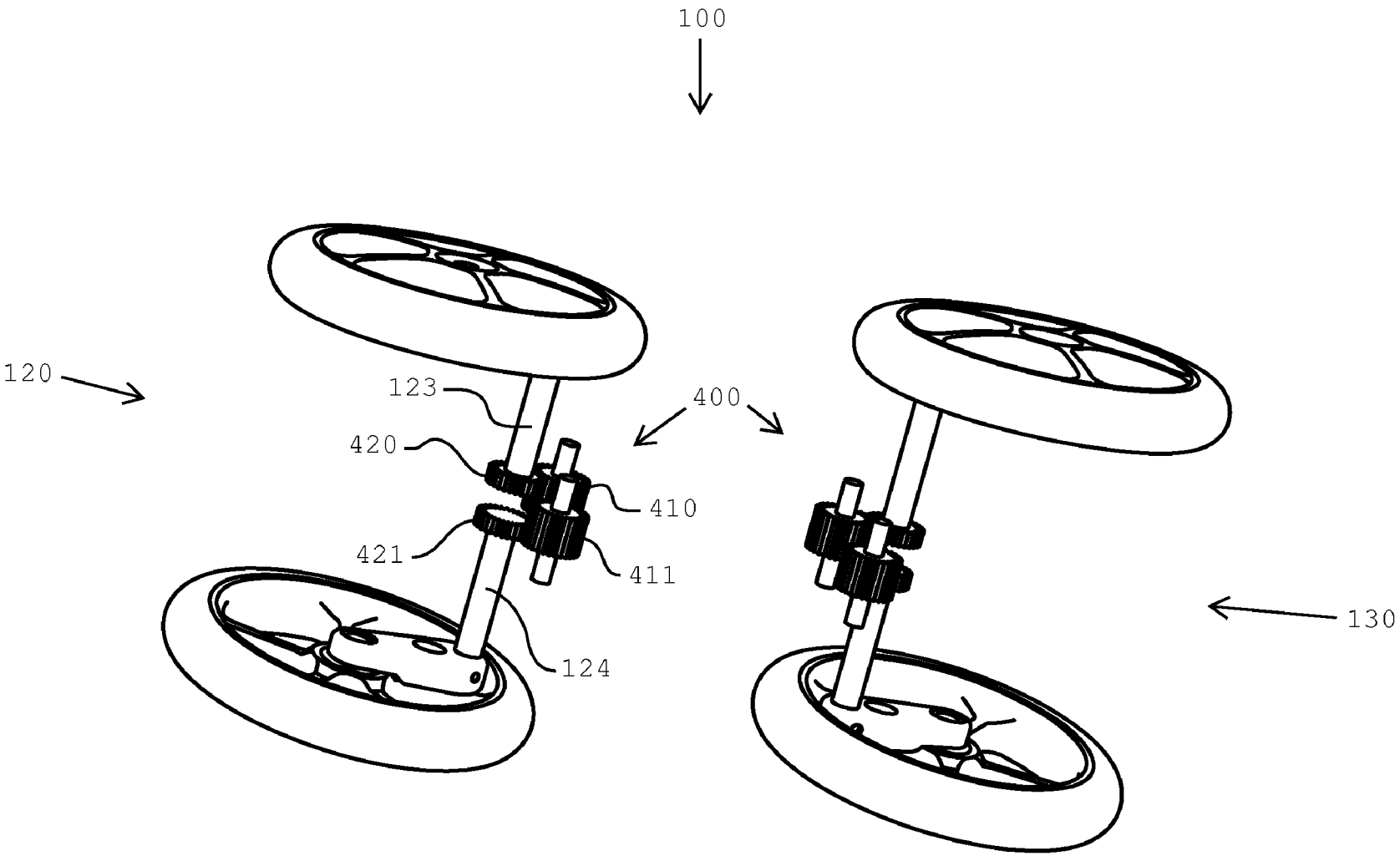

Referring to FIG. 11, a perspective view of two turnable wheel assemblies in turning position in accordance with the present invention are shown, with base 110 excluded for clarity. Each turnable wheel assembly 120, 130 may include a linking mechanism 400, which ensures that both wheels associated with the same turnable wheel assembly undergo substantially equal changes in angle. In the embodiment shown, linking mechanism 400 may include linking gears 410, 411, which communicate with each other. Shaft members 123, 124 may be respectively coupled to axle gears 420, 421, which respectively communicate with linking gears 410, 411. Pivoting of one shaft member in one direction causes pivoting of the other shaft in the opposite direction by means of axle gears 420, 421 and linking gears 410, 411.

Note that while a pivot rod-based arrangement, a cable-and-pulley arrangement, and a gear-based arrangement for linking mechanism 200 are shown and described, the linkage of the wheels may be accomplished in other ways without departing from the present invention.

A bias mechanism or bias mechanisms, not shown in any of the figures, may also be included, whereby the wheels are biased toward the non-turning position. The turnable wheel assemblies can thereby return to non-turning configuration when wheeled device 100 is lifted off the ground, so that the wheels will be in non-turning position upon returning to contact with the ground. There are various possible locations for the actual biasing member or members (the spring, elastic band, flexible rod, etc.) and associated parts, such as adjacent to linking mechanism 200, or adjacent to the shaft members.

Suitable materials for skate manufacture are known in the art. Nonetheless, for shoe manufacture they may include leather and plastic and other materials, and for base or support structure they may include metals or plastics or other suitable materials (particularly materials with similar properties, i.e., relatively lightweight and strong). The wheels may be made of rubber, polyurethane or other suitable material.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A turnable wheeled device, comprising:

a base, laterally tiltable;

at least one turnable wheel assembly comprising:

two wheels;

two shaft members, each having a base axle and a wheel axle, the base axle being rotatably attached to the base, and each wheel being rotatably attached to the wheel axle of a respective shaft member;

wherein the wheel axles of the two shaft members are not parallel to the base axles, resulting in the two wheels having negative camber angle when in non-turning position;

wherein the wheel axles and the base axles are furthermore not coplanar, by means of an offset between each wheel axle and its respective base axle;

wherein both wheel axles are offset in substantially the same direction;

and wherein the wheel axle and the base axle are connected by a middle section.

2. The device of claim 1, wherein a cavity in each of the two wheels allows the middle sections of the two shaft members to be at least partially contained inside their respective wheels.

3. The device of claim 1, further comprising a linking mechanism restricting the displacement of the two wheels to opposite directions.

4. The device of claim 3, wherein the linking mechanism is achieved by a system of gears.

5. The device of claim 3, wherein the linking mechanism is achieved by cables and pulleys.

6. The device of claim 3, wherein the linking mechanism comprises a linking shaft coupled to a linking bar.

7. The device of claim 1, wherein at least one of the two wheels is biased toward the non-turning position.

8. The device of claim 1, wherein the two wheels have diameters larger than one hundred (100) millimeters.

9. The device of claim 1, further comprising a braking mechanism.

* * * * *